United States Patent [19]

Alvarez, Jr.

[11] Patent Number: 4,815,745

[45] Date of Patent: Mar. 28, 1989

[54] STRATEGY BOARD GAME

[76] Inventor: Manuel M. Alvarez, Jr., 632 N. Tularosa Dr. #4, Los Angeles, Calif. 90026

[21] Appl. No.: 92,062

[22] Filed: Sep. 2, 1987

[51] Int. Cl.[4] ..... A63F 3/00

[52] U.S. Cl. ..... 273/259

[58] Field of Search ..... 273/258, 259, 260, 261, 273/262, 263, 264

[56] References Cited

U.S. PATENT DOCUMENTS

| | | | |
|---|---|---|---|
| 500,409 | 6/1893 | Monks | 273/259 |
| 1,190,003 | 7/1916 | Quinn | 273/259 |
| 1,602,639 | 10/1926 | Bosco | 273/259 X |
| 3,386,738 | 6/1968 | Wylie | 273/259 |
| 4,478,419 | 10/1984 | Maiers | 273/259 |
| 4,700,951 | 10/1987 | Lachenmeier et al. | 273/264 |

*Primary Examiner*—Anton O. Oechsle

*Attorney, Agent, or Firm*—Natan Epstein

[57] ABSTRACT

A novel entertainment game played on a board with two opposite end zones and an intermediate grid field. Two players take turns between offensive and defensive roles in successive plays. The offense seeks to score a touchdown by moving a ball into the opponent's end zone, while the defense seeks to block or intercept the ball by moving respective play pieces on the grid according to specified rules.

6 Claims, 6 Drawing Sheets

STRATEGY BOARD GAME

BACKGROUND OF THE INVENTION

1. Field of the Invention

The present invention pertains generally to the field of entertainment games and more particularly to a strategy board game for two adversary players.

2. State of the Prior Art

Of the numerous competitive board games known, the novel game of this invention draws on elements found in the games of checkers, chess, and touch football which elements are combined in a novel strategy game which may be easily and quickly learned by even young players. The play can be fast paced with players exchanging defensive and offensive roles as frequently as every few minutes, yet also offers the opportunity for sophisticated game strategy and skill.

SUMMARY OF THE INVENTION

The strategy board game for two players of this invention comprises the steps of providing a game board with first and second end zones separated by an intermediate field including longitudinal columns connecting the end zones and transverse rows defining a grid.

One player is provided with an X number of defensive playing pieces and the other player is provided with an X-1 number of offensive playing pieces plus a "ball" piece. The game is played as a succession of individual plays similar to the game pattern of American football. The two players alternate between offensive and defensive roles at the conclusion of each play. The object of each play is for the offensive player to score a touchdown by moving the ball into the defensive player's end zone. At the end of a predetermined period of time or number of plays, the player with the highest score is declared the winner.

Each player's pieces are lined up in a row across the field with one piece to each square of the grid. Each player takes alternate turns to move any one of its pieces according to any of the following three rules:

(a) a "rush" move to any immediately adjacent empty square; or (b) a "pass" move jumping over any two or more pieces of the same player contiguously aligned along the same row, column, or diagonal occupied by and immediately adjacent to the moving piece, the moving piece landing in the first empty square in said row, column, or diagonal at the far end of the contiguously aligned pieces; or (c) an "L" or "knight" move between the end squares of an L-pattern including a long leg of three squares along one row or column and a short leg of two squares along a perpendicular column or row, provided that the intermediate squares of the L-pattern, i.e. the two inner squares of the long leg are occupied by two consecutive pieces of the same player and that the moving pieces is immediately adjacent to one of these two consecutive pieces along a common row or column. This move may also be understood as similar to the movement of a knight in the game of chess, with the distinction that this knight move is allowed only if the moving piece in the present game in doing so passes over two other pieces of the same player.

The two players continue taking repeated turns and making alternate moves until the play ends when either (a) the second player scores a touchdown by moving the "ball" into his opponent's end zone, or (b) the "ball" is "sacked" by the first player i.e. blocked against further movement by other pieces on the grid field, or (c) the ball is "intercepted" by the first player by landing a defensive piece on the "ball" in a "pass" move according to rule (b) above.

It is preferred that the board provided for this game have a field with five rows and six columns defining a grid containing 30 squares and that the aforementioned number X of playing pieces be equal to the number of squares in each row of the grid field.

A playing time limit may be set. Within the alloted time period the offensive/defensive roles of the two players are reversed after the end of each play and a new play is commenced. A cumulative touchdown score by each player is kept within the alloted playing time limit, and the player with the highest score at the end of this period is declared the winner. Preferably a touchdown scored by a "rush" move is assigned a lower numerical score than one scored by a "pass" move into the defensive player's end zone.

It may also be found desirable to set a maximum number of offensive moves per play and ending a parituclar play in the event that no scoring takes place within the prescribed number of moves.

Following the end of each play a new play is commenced by lining up the playing pieces according to the following rules:

(a) the defensive pieces are always lined up on the row adjacent the new defensive player's end zone.

(b) the defensive pieces are lined up along the row where the ball waas either "sacked" or intercepted in the just ended play, provided however that the offensive pieces are to be moved back one row away from the defensive end zone if the ball was intercepted or "sacked" at the new defensive player's starting row.

(c) the offensive pieces are lined up on the row adjacent to the new offensive player's end zone following either a touchdown score or a failure to score in a prescribed number of offensive moves in the previous play.

TABLES AT THE END OF THE SPECIFICATION

Table A lists the offensive and defensive moves of the play of FIGS. 2–21;

Table B records the move sequence of a second play (not illustrated in pictorial form) which ends without scoring in a ball intercept by the defense;

Table C records the move sequence of a third play in which the offense scores a touchdown in a pass move.

DETAILED DESCRIPTION OF THE PREFERRED EMBODIMENT

Figure 1:
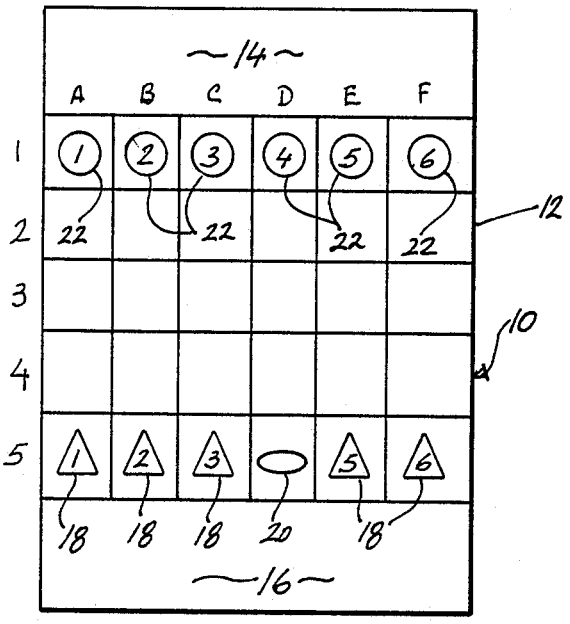
FIG. 1 shows the game board and the playing pieces of the novel strategy game in beginning position.

With reference to the drawings, FIG. 1 shows a game board 10 on which is played the novel strategy game here disclosed. The board 10 is rectangular and includes a field 12 intermediate an upper end zone 14 and a lower end zone 16. The intermediate field 12 is divided into six vertical or longitudinal columns lettered A through F connecting the two end zones 14, 16, and five horizontal or transverse rows numbered 1 through 5. The columns and rows of field 12 together define a rectangular grid consisting of 30 squares.

The game is intended for two adversary players, one of which initially assumes an offensive role, the other a defensive role. Each player is given six playing pieces, i.e. a number equal to the number of squares in each transverse row 1–5. The six pieces given to the offense player include five substantially similar playing pieces 18 shown in the drawings as triangles numbered 1 through 5, and a ball piece 20 shown as an elliptical symbol suggestive of a football. The defense player on the other hand is provided with six mutually similar defensive playing pieces 22 shown in the drawings as circular disks numbered 1–6. Play is begun from an initial lineup shown in FIG. 1. The players take sides on the board 12, and the defensive pieces 22 are lined up in individual squares across the row immediately adjacent the defensive end zone, namely row 1 adjacent to end zone 14 in the illustrated example. The offensive pieces are lined up one piece per square across the row immediately adjacent the offensive end zone, row 5 immediately above end zone 16 in FIG. 1. The ball 20 may occupy either of the two center squares of the six square row at the offensive player's option. Play is begun by the offensive player, the two players thereafter taking turns to each alternately move one of their respective play pieces according to any one of the following three rules:

(a) a "rush" move from the piece's current position to any immediately adjacent unoccupied square; or (b) a "pass" where the piece moves from its present position along the row, column, or diagonals containing the moving piece to a landing position in an unoccupied square in the same row, column, or diagonal, provided that all squares between the moving piece's present position and landing position must be occupied by two or more pieces of the same player; or (c) an "L" or "knight" move between the end squares of an L-pattern including a long leg three squares long and a short leg two squares long, the two legs having a common square at the corner of the pattern. The two legs always must lie vertically and horizontally on the grid but not diagonally, and the two intermediate squares of the L-pattern between the beginning and landing squares must each be occupied by a piece of the same player. This move which will be better understood from the examples described below, may also be understood as similar to the movement of a knight in the game of chess, with the difference that in the present game this knight move is allowed only if the moving piece passes over pieces of the same player. The total length of the L path is four squares including three squares in a row or column (the long leg) plus one square to either side of one of the end squares of the row (the short leg).

Figure 2:
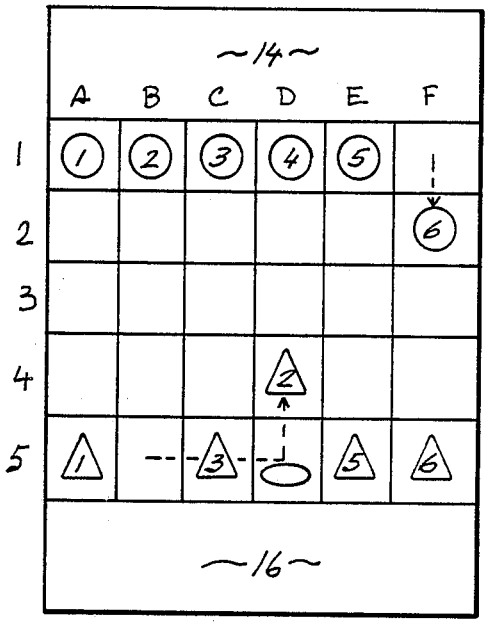
FIGS. 2–21 illustrate the moves of a play which terminates in a touchdown scored by the offense in a rush move.

In the following description and in Tables A–C the triangular offensive pieces are designated by the letter T and the circular defensive pieces by the letter O. In FIG. 2 play begins with offensive player making an L or Knight move with T2 from square B5 to square D4. The move is according to rule (c) above including a long leg comprising squares B5, C5, D5 and a short perpendicular leg comprising squares D5, D4. The corner square D5 of the L is occupied by the offensive ball piece, while the intermediate square C5 is occupied by T3, and the moving piece T2 passes over these two other offensive pieces in moving from the starting square B5 to the ending square D4. The defense responds by making a rush move forward with 06 from square 1 to square 2 along column F according to rule (a).

Figure 3:
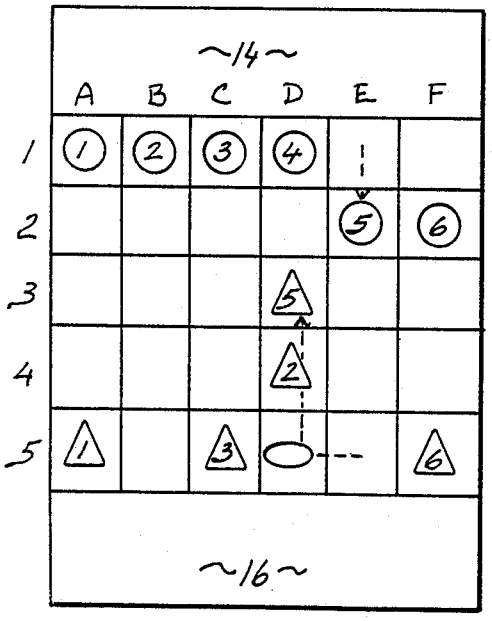

Turn now to FIG. 3 showing a second offensive L move T5 to square D3. It will be noticed that the L move in FIG. 3 begins along the short leg consisting of squares E5, D5 and ends along the end square D3 of the long leg D5, D4 and D3, the moving piece passing over the offensive ball pieces and T2. The defense counters with another rush move 05 to E2.

Figure 4:
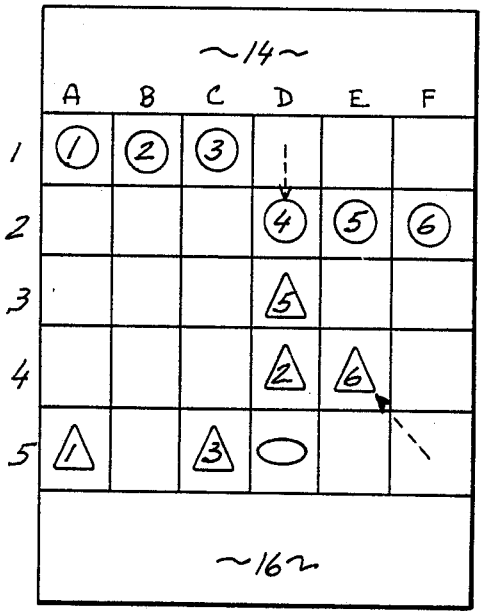
Figure 5:
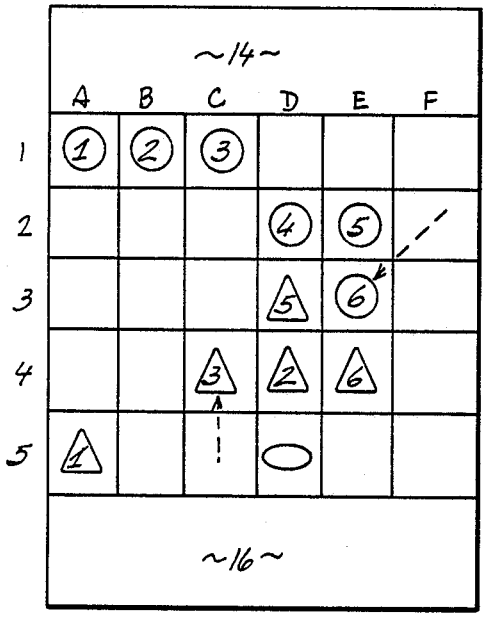
Figure 6:
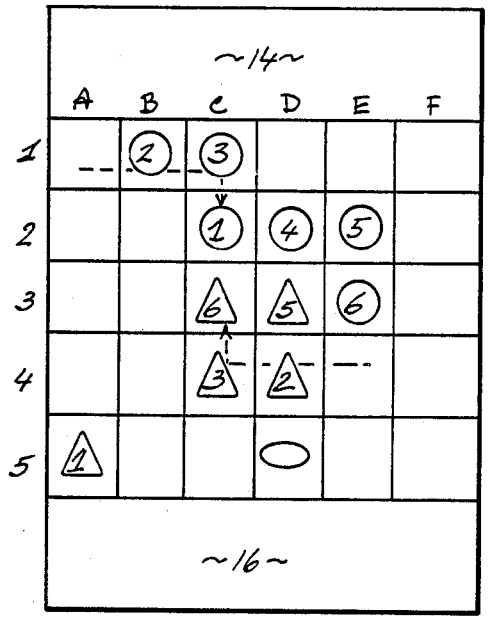
Figure 7:
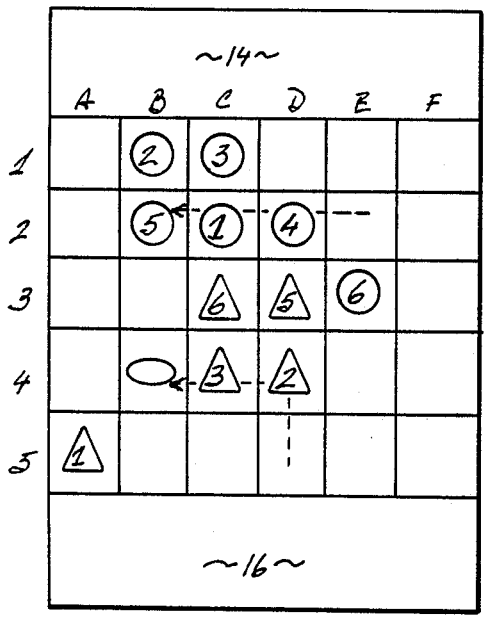
Figure 8:
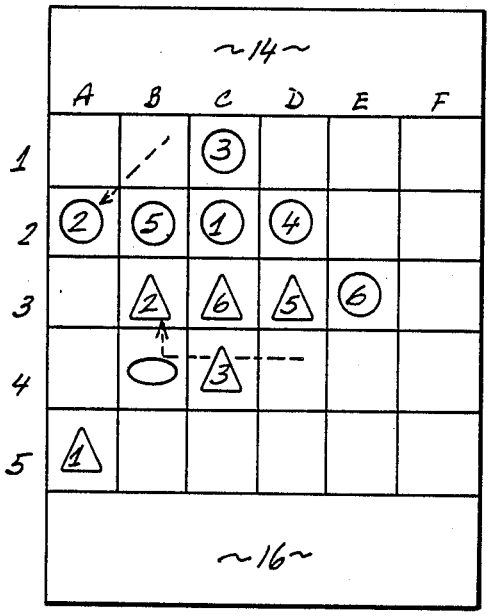
Figure 9:
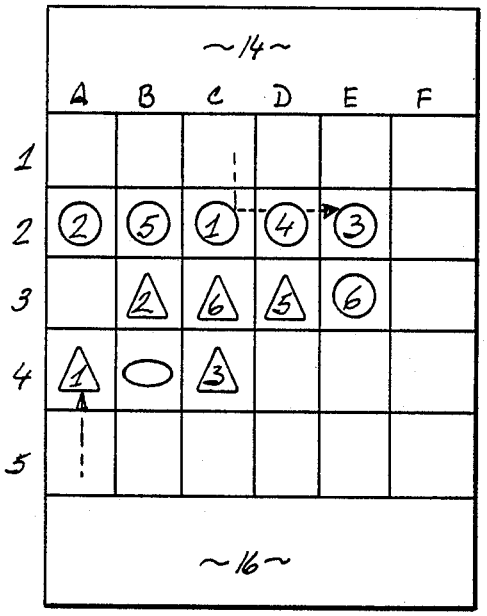
Figure 10:
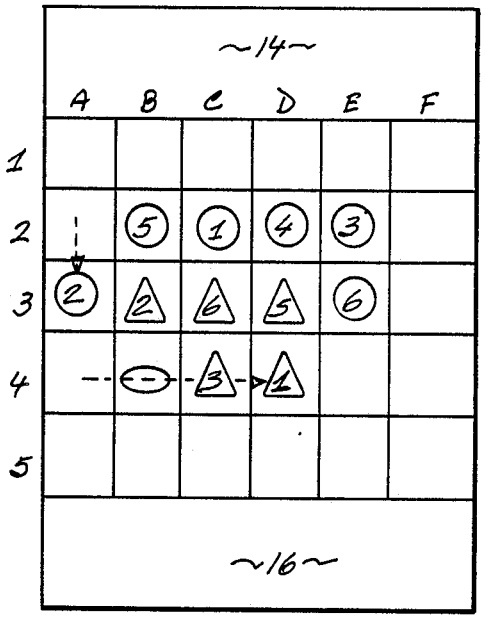
Figure 11:
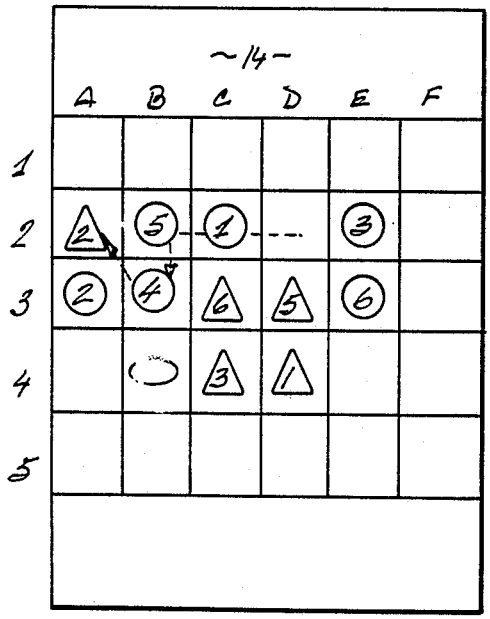

In FIG. 4, offense moves T6 in a diagonal rush move to E4 while defense counters with a vertical rush move 04 to D2. Additional vertical and diagonal rush moves are made in FIG. 5. In FIG. 6, both sides make L moves, both of which begin along the long leg and end on the short leg of the L path.

Figure 12:
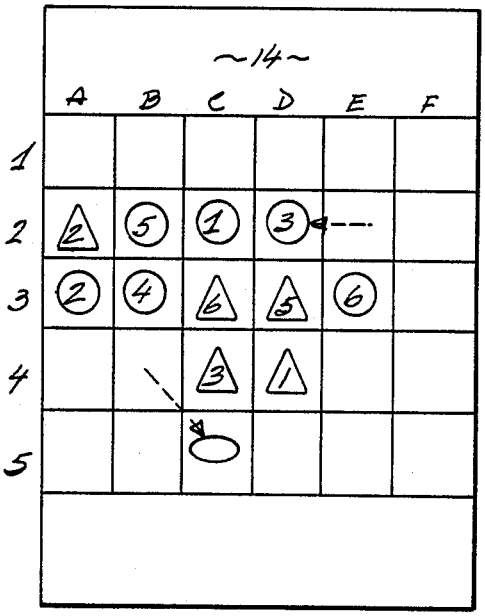
Figure 13:
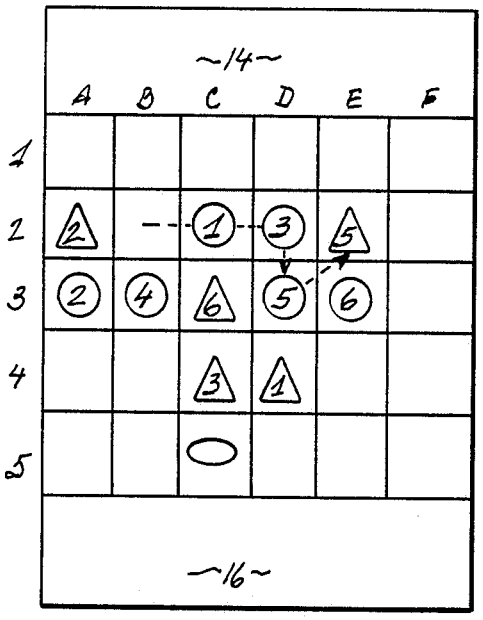
Figure 14:
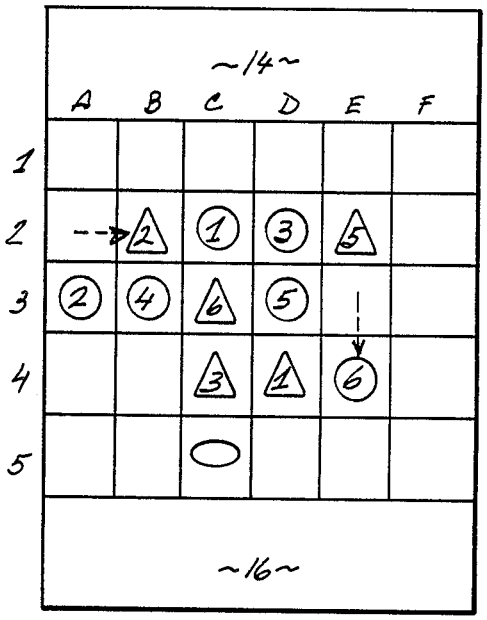
Figure 15:
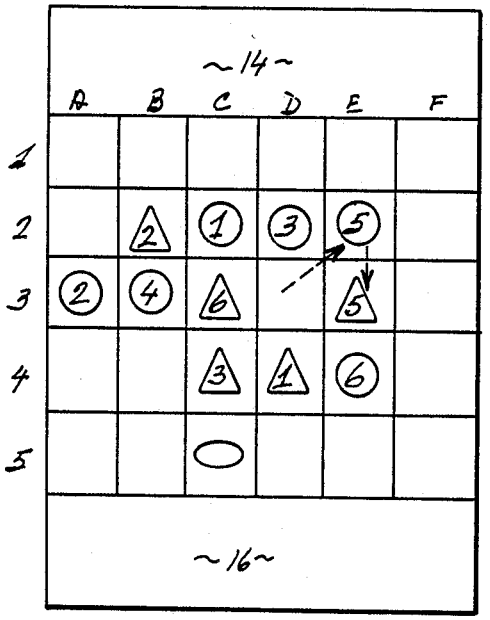
Figure 16:
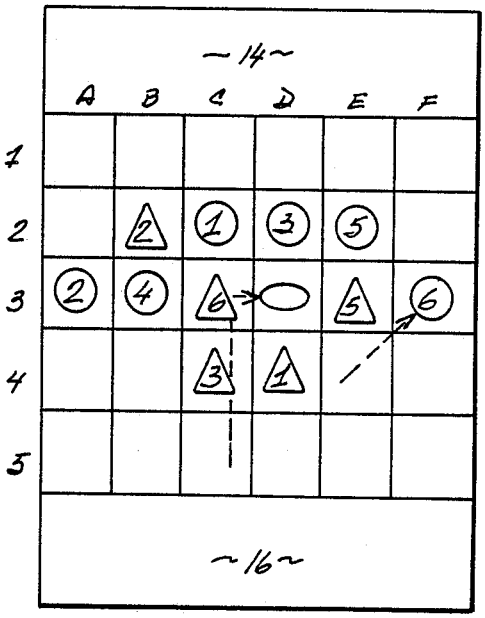

In FIG. 7, the offensive again makes an L move beginning along short leg D5, D4 and terminating at end square B4 of the long leg. The offense chooses to make a pass from beginning square E to ending square B2, in the process passing over offensive pieces 01 and 04 occupying the two intervening squares C2 and D2 between the beginning and ending squares of the pass move. The game continues through FIGS. 8–11 with moves similar to those already explained. In FIG. 12, the offense makes a diagonal rush move backwards with the ball piece towards its own end zone 16 from square B4 to square C5 consistent with moving rule (a) which allows any piece to move to any immediately adjacent empty square regardless of the direction of movement.

It will be noticed that in making either a pass move or an L move, an offensive triangular piece may pass over the ball as though it were also a triangular piece, and that the triangle pieces and the ball follow exactly the same rules of movement, either being capable of rush, pass or L moves according to the same rules. It will also be appreciated that the legs of all L or Knight moves always lie along a row and a column, i.e. the legs are vertical and horizontal on the board, never diagonal.

Play continues in FIGS. 13–16 with further moves of a nature already explained.

Figure 17:
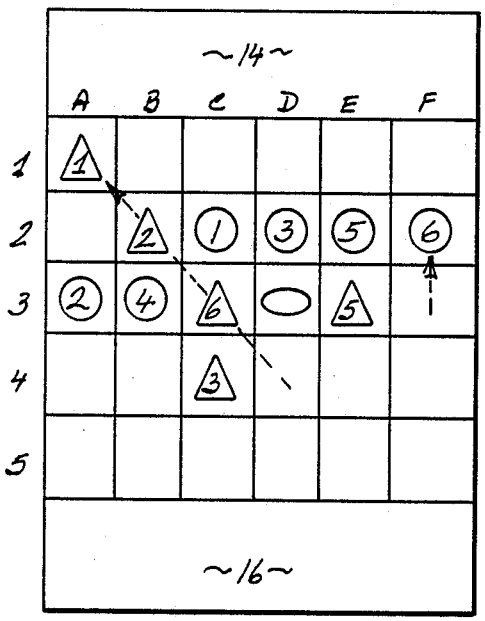
Figure 18:
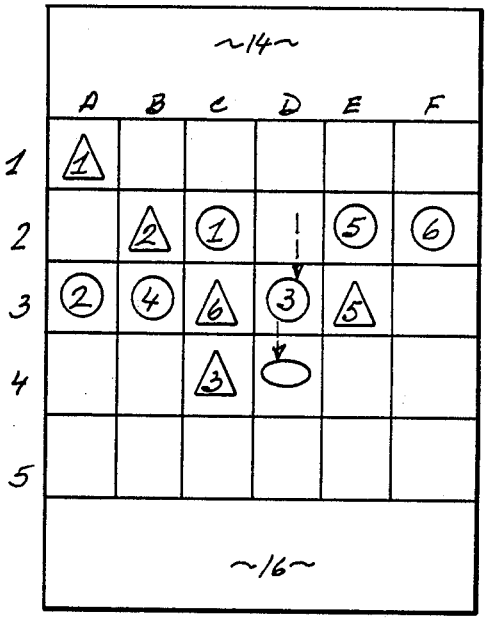
Figure 19:
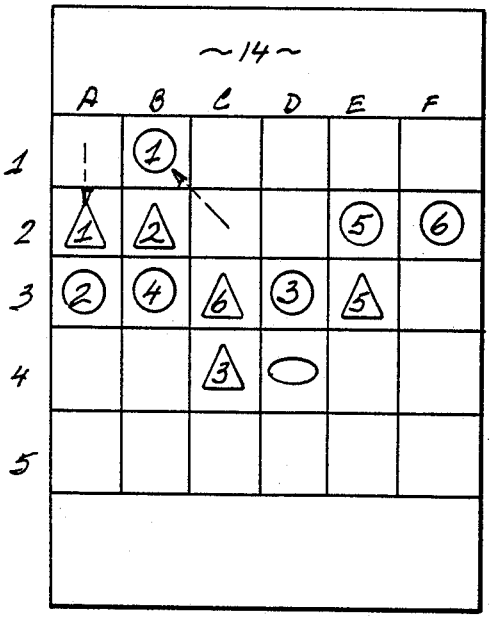
Figure 20:
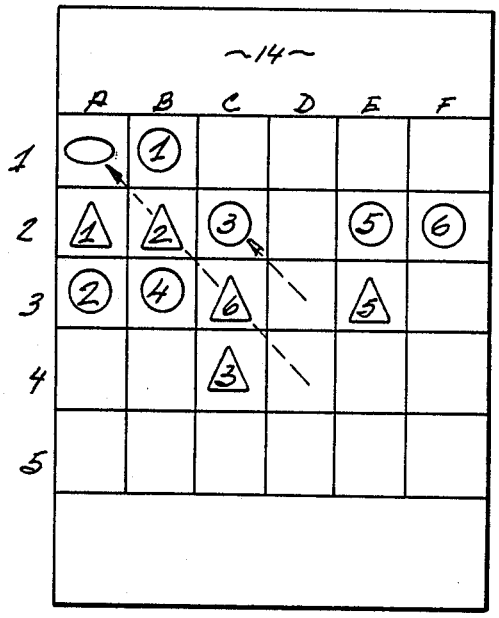
Figure 21:
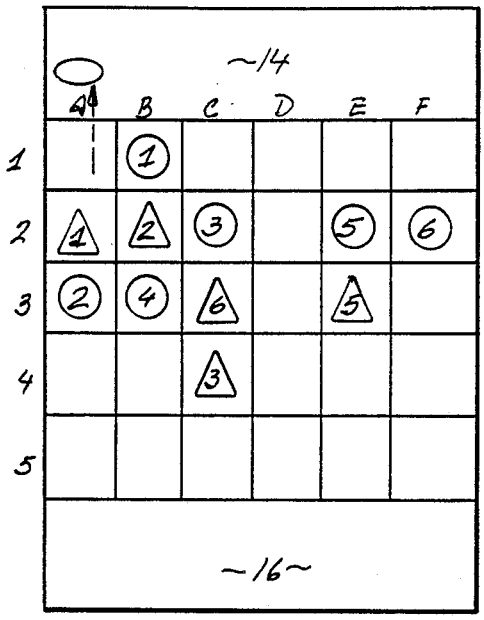

In FIG. 17, offensive piece T1 makes a diagonal pass move from square D4 to ending square A1 in the process passing over offensive pieces T2 and T6 occupying respectively the two intervening squares B2 and C3 in accordance with moving rule (b) above. The players then exchange a number of one square rush moves through FIGS. 18 and 19 where the offense prepares for a decisive pass move of the ball from its position at square D4 diagonally to square A1 immediately adjacent to the defensive end zone. Following this pass the defense is unable to stop the ball from making a touchdown in the defensive end zone. The touchdown is made by a rush move into the end zone from square A1. The defense makes a futile move from D3 to C2 with piece 03, the play concluding with a rush touchdown in FIG. 21.

The first play of the game recorded in Table A has ended and the players now exchange playing pieces and assume roles opposite to their roles in the previous, just ended play. After a touchdown the playing pieces are lined up on the row nearest each player's end zone with the end zone 14 now becoming the offensive side's end zone, and the lower end zone 16 being the touchdown goal for the offensive. The six defensive pieces line up along row 5, and the offensive pieces line up along row 1 with the ball 20 in either of squares C1 or D1. The second play of the game develops as recorded in Table B and the play ends in a defensive intercept of the ball at square B2 in the 11th move.

The players again exchange pieces such that the players revert to their original roles i.e. end zone 14 being the touchdown goal of the offense. Following an intercept of the ball, the new offense player retains the benefit of the advance position of the ball on the playing field 12, i.e. the offensive pieces line up in whichever row the ball was intercepted, and the ball remains in the intercept position namely square B2. The exception to this rule is where the ball is intercepted in the row 1 or 5 where the defensive pieces are to be lined up at the beginning of the next play. In this case, the offensive pieces and the ball are lined up on the next adjacent row, row 2 or row 4 respectively so as to allow positioning of the defensive pieces between the offensive line up and the end zone being defended. It will be appreciated that in such a line up there is no space between the offensive and defensive line ups and the offense must begin play by moving a piece backward on the field 12. The defensive pieces however, always begin play from the row adjacent to the defensive end zone 14 in this example.

The third play of this game therefore begins with the defensive pieces lined up along row one and the offensive pieces lined up along row 2 with the ball at square B2. The third play of the game develops as recorded in Table C with the game ending with a touchdown scored by a pass in the fourth move.

At this point, player B has scored two touchdowns, one touchdown by rush move and one touchdown by pass move. The greater difficulty of scoring by a pass move is recognized by assigning a higher point score to a touchdown achieved in such manner. For example, a pass touchdown is awarded six points as against a single point for a rush touchdown. Player A has score no points in the game so far and the game score stands at 7–0.

A particular game may end upon lapse of a prescribed time period which may be arbitrarily set by the players or in some other manner. For example, a game time of 15 minutes may be set. As each player is completed during this time period a numerical point score is accumulated for each player according to the aforementioned scoring rules for each play completed during the allowed time. At the end of the specified game period, the player with the highest point score is declared the winner. Of course, the game may be limited in ways other than by specified played time, as for example specifying a given number of plays to be completed, preferably an even number of plays so as to give each player an equal opportunity for scoring against the opponent. It may also be desirable to limit the number of moves per play so as to avoid unduly protracted playing where the tactical situation on the board offers no realistic opportunity of scoring in a reasonable time. For example, a limit of 30 moves by each player per play may be prescribed, and if the move limit is reached without scoring, the play turns over i.e. begins anew with the players exchanging roles and the pieces being lined up adjacent to the respective end zones as in FIG. 1.

While a presently preferred embodiment of the invention has been shown and illustrated for purposes of clarity and example, various changes, substitutions and modifications to the game will become apparent to those possessed of ordinary skill in the art without thereby departing from the spirit and scope of the present invention which is defined and limited only by the claims below. In particular, it will be understood that the physical form of the game board and game pieces may take many different forms without affecting the essence of the novel game. The end zones for instance, could be physically omitted from a game board which in such case may consist of nothing but the rectangular grid field 12 of the drawings, it being understood that a touchdown is scored by moving the ball off the board at the respective end of the grid. For easier visualization, it may be desirable to provide the playing field 12 as a checkered field with alternating light and dark squares in lieu of the playing grid illustrated in the drawings. Furthermore, the game may be played on a grid larger or smaller than the illustrated 5 by 6 arrangement, with a corresponding increase or decrease in the number of playing pieces. The physical appearance of the playing pieces may be similar to that of checkers of two colors with a ball emblem imprinted on one side of one piece of each team. This one piece is played with the ball insignia down for the defensive player and with ball design facing up and visible for the offensive player. These two pieces are respectively reversed when the play turns over and the team roles are reversed. Alternately, the playing pieces may be fashioned in more elaborate manner, as for example, in the shape of carved football helmets of different colors or designs for each side and with a separate ball piece provided and substituted for a helmet piece by the current offensive player. The design, arrangement construction and appearance of the board and playing pieces is thus limited only by the imagination of the game maker and should not be taken to limit the scope of protection provided by the appended claims.

TABLE A

| OFFENSIVE PLAY | | | DEFENSIVE PLAY | |
|---|---|---|---|---|
| 1. | T2 | D4 | 06 | F2 |
| 2. | T5 | D3 | 05 | E2 |
| 3. | T6 | E4 | 04 | D2 |
| 4. | T3 | C4 | 06 | E3 |
| 5. | T6 | C3 | 01 | C2 |
| 6. | BALL | B4 | 05 | B2 |
| 7. | T2 | B3 | 02 | A2 |
| 8. | T1 | A4 | 03 | E2 |
| 9. | T1 | D4 | 02 | A3 |
| 10. | T2 | A2 | 04 | B3 |
| 11. | BALL | C5 | 03 | D2 |
| 12. | T5 | E2 | 05 | D3 |
| 13. | T2 | B2 | 06 | E4 |
| 14. | T5 | E3 | 05 | E2 |
| 15. | BALL | D3 | 06 | F3 |
| 16. | T1 | A1 | 06 | F2 |
| 17. | BALL | D4 | 03 | D3 |
| 18. | T1 | A2 | 01 | B1 |
| 19. | BALL | A1 | 03 | C2 |
| 20. | BALL RUSH TO TOUCHDOWN ONE (1) POINT SCORED | | | |

TABLE B

| OFFENSIVE PLAY | | | DEFENSIVE PLAY | |
|---|---|---|---|---|
| 1. | T1 | C2 | 06 | D4 |
| 2. | T6 | D2 | 05 | D3 |
| 3. | T4 | C3 | 03 | C4 |
| 4. | T5 | B4 | 04 | E3 |
| 5. | BALL | B3 | 01 | A4 |
| 6. | T6 | A5 | 04 | D2 |
| 7. | T1 | A3 | 06 | C2 |
| 8. | T4 | D4 | 06 | C3 |
| 9. | BALL | C2 | 02 | C5 |
| 10. | BALL | C1 | 02 | C2 |
| 11. | BALL | B2 | 03 | B2 TO |

TABLE B-continued

| OFFENSIVE PLAY | DEFENSIVE PLAY |
|---|---|
| INTERCEPT | |

TABLE C

| OFFENSIVE PLAY | | DEFENSIVE PLAY | |
|---|---|---|---|
| 1. BALL | C3 | 02 | B2 |
| 2. T1 | B1 | 02 | B3 |
| 3. BALL | D3 | 02 | C3 |
| 4. BALL PASS TO TOUCHDOWN SIX (6) POINTS SCORED | | | |

What is claimed is:

1. A strategy board game for two players comprising the steps of:

providing a game board having first and second end zones separated by an intermediate field including longitudinal columns connecting said end zones and transverse rows defining a grid;

providing the first player with a first plurality of playing pieces and the second player with a second plurality of playing pieces plus a "ball" piece;

lining up each player's pieces across said field with one piece to each square;

the players taking turns to each move one of its pieces according to any of the following three rules:

(a) any piece can move to any immediately adjacent unoccupied square; or (b) any piece can move from its current position along a row, column or diagonal to a landing position provided that the moving piece must pass over at least two pieces of the same player and that every square between the current position and the landing position is occupied by the same player's playing pieces; or (c) any piece can move from its current position to a landing position in an L-pattern including a long leg three squares long and a short leg two squares long with a common corner square provided with intermediate squares of the L-pattern are occupied by two pieces of the same player;

said step of taking alternate turns being repeated until either said second player has moved said "ball" piece into his opponent's end zone, or said "ball" piece is blocked against further movement by other pieces, or said first player intercepts the ball by landing one of its pieces on the "ball" piece in a pass move according to said rule (b), thereby ending the play.

2. The game of claim 1 wherein said step of providing the board includes providing a board having a field with five rows and six columns defining a grid containing 30 squares.

3. The game of claim 1 further comprising the steps of:

setting a playing time limit;

reversing the offensive/defensive roles of said two players following each play;

recommencing the play after each said ending step; and keeping a cumulative score of touchdowns scored by each said player within said playing time limit.

4. The game of claim 2 further comprising the step of according a given lower numerical score to a play won by a step move into the defensive layer's end zone and a given higher numerical score to a play won by a pass move into the same end zone.

5. The game of claim 1 further comprising the step of setting a maximum number of permissible offensive moves and ending the play in the event that no scoring takes place within the prescribed number of moves.

6. The game of any of claims 3, 4 or 5 wherein said step of recommencing comprises the step of lining up the playing pieces according to the following rules:

(a) the defensive pieces are always lined up on the row adjacent the current defensive player's end zone;

(b) the offensive pieces are lined up along the row where the ball was either "sacked" or intercepted in the previous play, provided however that the offensive pieces are to be moved back one row away from the defensive end zone if the ball was intercepted or "sacked" at the new defensive player's starting row;

(c) the offensive pieces are lined up on the row adjacent to the current offensive player's end zone following either a touchdown score or a failure to score in a prescribed number of offensive moves in the previous play.

* * * * *